US005728517A

United States Patent [19]

Bryant et al.

[11] Patent Number: 5,728,517

[45] Date of Patent: Mar. 17, 1998

[54] PHOTOGRAPHIC EMULSIONS OF ENHANCED SENSITIVITY

[75] Inventors: Roger Anthony Bryant, Rochester; Myra Toffolon Olm, Webster; David Earl Fenton, Fairport, all of N.Y.

[73] Assignee: Eastman Kodak Company, Rochester, N.Y.

[21] Appl. No.: 656,019

[22] Filed: May 31, 1996

Related U.S. Application Data

[60] Provisional application No. 60/000,723, Jun. 30, 1995.

[51] Int. Cl.[6] ..... G03C 1/035; G03C 1/005; G03C 1/09

[52] U.S. Cl. ..... 430/567; 430/569; 430/604; 430/605; 430/581

[58] Field of Search ..... 430/567, 569, 430/604, 605, 581

[56] References Cited

U.S. PATENT DOCUMENTS

| | | | |
|---|---|---|---|
| 4,210,450 | 7/1980 | Corben | 430/567 |
| 4,433,048 | 2/1984 | Solberg et al. | 430/434 |
| 4,439,520 | 3/1984 | Kofron et al. | 430/434 |
| 4,883,748 | 11/1989 | Hayakawa | 430/567 |
| 4,937,180 | 6/1990 | Marchetti et al. | 430/567 |
| 5,061,609 | 10/1991 | Piggin et al. | 430/569 |
| 5,061,616 | 10/1991 | Piggin et al. | 430/569 |
| 5,132,203 | 7/1992 | Bell et al. | 430/567 |
| 5,206,133 | 4/1993 | Bando | 430/567 |
| 5,268,264 | 12/1993 | Marchetti et al. | 430/567 |
| 5,314,798 | 5/1994 | Brust et al. | 430/567 |
| 5,358,840 | 10/1994 | Chaffee et al. | 430/567 |
| 5,476,760 | 12/1995 | Fenton et al. | 430/567 |
| 5,536,632 | 7/1996 | Wen et al. | 430/567 |
| 5,567,580 | 10/1996 | Fenton et al. | 430/567 |
| 5,576,172 | 11/1996 | Olm et al. | 430/567 |

FOREIGN PATENT DOCUMENTS

| | | | |
|---|---|---|---|
| 96/13757 | 5/1996 | WIPO | G03C 1/005 |

OTHER PUBLICATIONS

Research Disclosure, vol. 367, Nov. 1994, Item 36736.

*Primary Examiner*—Mark F. Huff
*Attorney, Agent, or Firm*—Carl O. Thomas

[57] ABSTRACT

Tabular grain emulsions of enhanced photographic sensitivity are disclosed in which the tabular grains contain a maximum surface iodide concentration along their edges and a lower surface iodide concentration within their corners than elsewhere along their edges. The grains contain a dopant capable of providing shallow electron trapping sites.

10 Claims, 1 Drawing Sheet

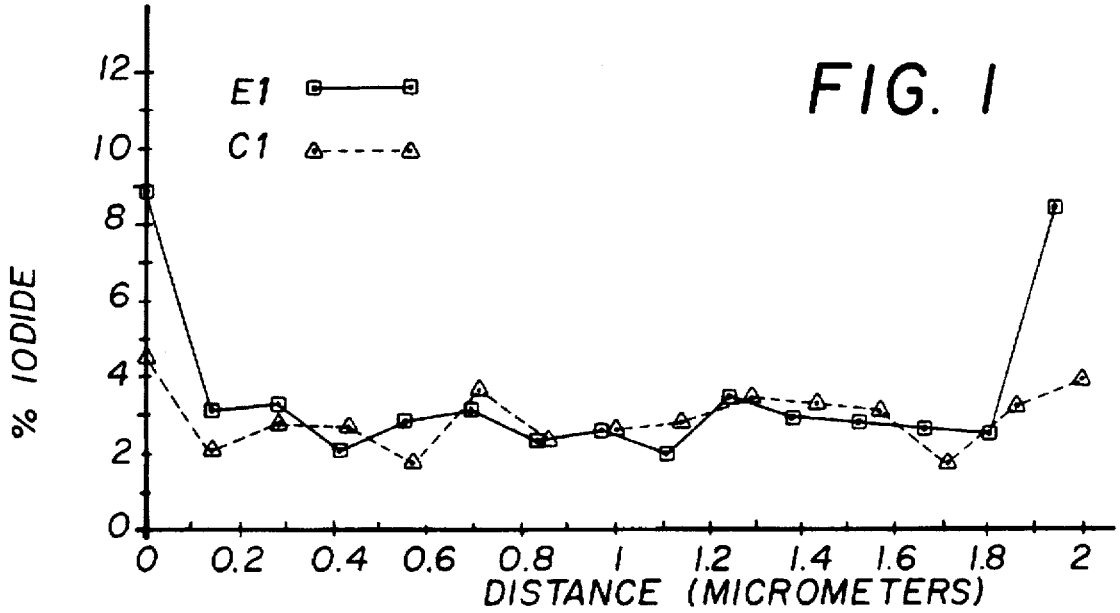
FIG. 1
FIG. 2
(CONTROL)
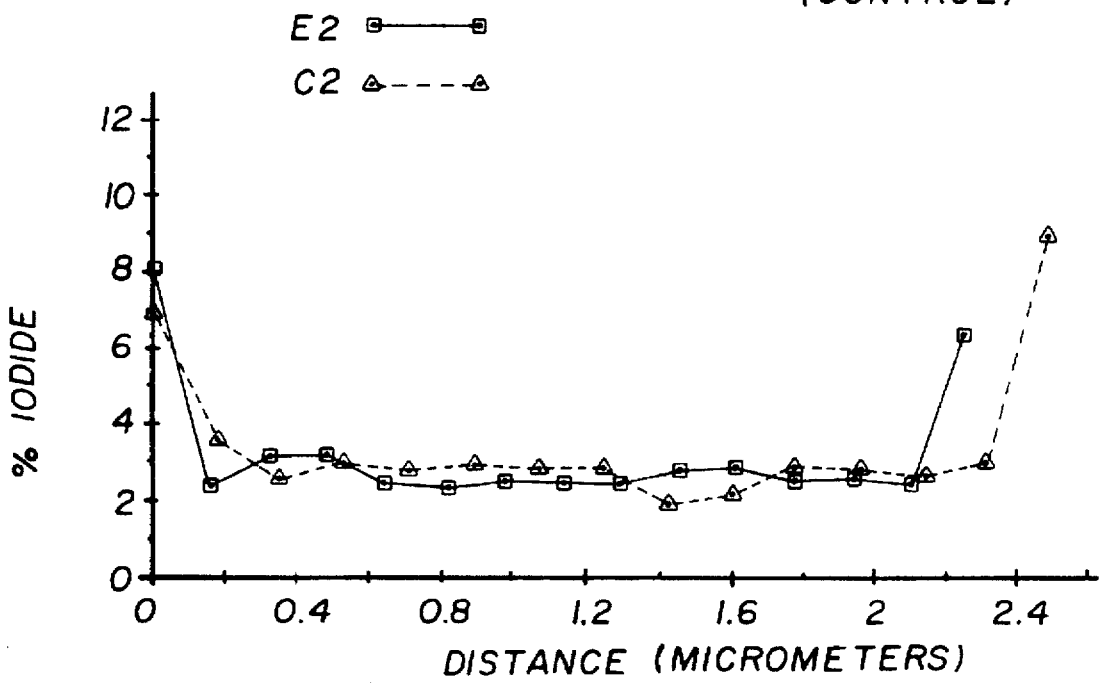

PHOTOGRAPHIC EMULSIONS OF ENHANCED SENSITIVITY

CROSS REFERENCE TO RELATED APPLICATION

Reference is made to and priority claimed from U.S. Provisional application Ser. No. 60/000,723, filed 30 Jun. 1995, entitled PHOTOGRAPHIC EMULSIONS OF ENHANCED SENSITIVITY.

FIELD OF THE INVENTION

The invention relates to photographic emulsions and to processes for their preparation.

PRIOR ART

Kofron et al U.S. Pat. No. 4,439,520 was the first to demonstrate that tabular grain emulsions are capable of providing a variety of photographic advantages, including improvements in photographic sensitivity and speed-granularity relationships.

Solberg et al U.S. Pat. No. 4,433,048 was the first to demonstrate that tabular grain emulsions with higher iodide concentrations adjacent the peripheral edges of the tabular grains are capable of demonstrating photographic sensitivities higher than those of comparable tabular grain emulsions containing the same overall iodide concentrations, but uniformly distributed. Subsequently others have investigated tabular grain emulsions with non-uniform iodide distributions in which the highest iodide level occurs at a surface location, as illustrated by the following: Hayakawa U.S. Pat. No. 4,883,748, Piggin et al U.S. Pat. Nos. 5,061,609 and 5,061,616, Bell et al U.S. Pat. No. 5,132,203, Bando U.S. Pat. No. 5,206,133 and Brust et al U.S. Pat. No. 5,314,798.

Corben U.S. Pat. No. 4,210,450 discloses the preparation of a shelled converted halide emulsion by alternately ammoniacally precipitating silver chloroiodobromide and introducing ammonium iodide and then repeating the sequence. The emulsions are stated to be useful in color diffusion transfer, but no performance advantages are stated or demonstrated.

Chaffee et al U.S. Pat. No. 5,358,840 discloses a tabular grain emulsion in which iodide is present adjacent central portions of the tabular grain major faces extending to a depth of 0.02 μm in a concentration in excess of 6 mole percent with overall iodide concentration of the tabular grains being in the range of from 2 to <10 mole percent.

Marchetti et al U.S. Pat. No. 4,937,180 discloses an emulsion in which silver halide grains containing bromide and, optionally, iodide are formed in the presence of a hexacoordination complex of rhenium, ruthenium or osmium with at least four cyanide ligands.

Marchetti et al U.S. Pat. No. 5,268,264 discloses an emulsion in which silver halide grains having {111} crystal faces containing bromide and, optionally, iodide contain a buried shell formed in the presence of a hexacoordination complex of iron and at least 3 cyanide ligands.

Bell et al U.S. Pat. No. 5,132,203 discloses an emulsion in which tabular silver halide grains are formed of a host stratum containing at least 4 mole percent iodide and laminar strata containing less than 2 mole percent iodide. Each of laminar strata is comprised of surface layer forming one of the major faces and a subsurface immediately beneath the surface layer containing a hexacoordination complex of a Group VIII period 4 or 5 metal and at least three cyanide ligands.

*Research Disclosure*, Vol. 367, Nov. 1994, Item 36736, discloses dopants providing shallow electron trapping (SET) sites. *Research Disclosure* is published by Kenneth Mason Publications, Ltd., Dudley House, 12 North St., Emsworth, Hampshire P010 7DQ, England.

Fenton et al U.S. Ser. No. 08/329,591, filed Oct. 26, 1994, now U.S. Pat. No. 5,476,760 commonly assigned, titled PHOTOGRAPHIC EMULSIONS OF ENHANCED SENSITIVITY, discloses an emulsion of enhanced sensitivity comprised of a dispersing medium and silver halide tabular grains having a face centered cubic crystal lattice of the rock salt structure and containing iodide adjacent surfaces forming edges and corners of the tabular grains. The tabular grains contain a maximum surface iodide concentration along their edges and a lower surface iodide concentration within their corners than elsewhere along their edges. Conventional dopants are disclosed.

SUMMARY OF THE INVENTION

In one aspect the invention is directed to an emulsion of enhanced photographic sensitivity comprised of a dispersing medium and silver halide tabular grains having a face centered cubic crystal lattice of the rock salt structure and containing iodide adjacent surfaces forming edges and corners of said tabular grains wherein the tabular grains contain a maximum surface iodide concentration along their edges, a lower surface iodide concentration within their corners than elsewhere along their edges, and a dopant capable of providing shallow electron trapping sites present in an overall concentration of up to 500 molar parts per million, based on silver, and limited to a surface concentration of less than 100 molar parts per million, based on the last precipitated 5 percent of silver.

BRIEF DESCRIPTION OF THE DRAWINGS

FIGS. 1 and 2 each show the iodide concentration profiles of a tabular grain where the profile is taken from edge-to-edge (see line E—E below) or from corner-to-corner (see line C—C below), where FIG. 1 demonstrates profiles from a tabular grain emulsion satisfying the requirements of the invention and FIG. 2 demonstrates iodide profiles from a conventional tabular grain.

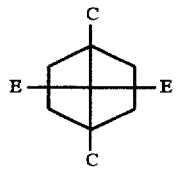

DESCRIPTION OF PREFERRED EMBODIMENTS

It has been discovered quite unexpectedly that enhanced levels of photographic sensitivity without offsetting degradation in granularity can be realized by managing the placement of surface (particularly, edge and corner) iodide in silver halide tabular grain emulsions in a manner that has not been heretofore recognized nor attempted. Specifically, the tabular grains contain a maximum surface iodide concentration along their edges and a lower surface iodide concentration within their corners than elsewhere along their edges. The term "surface iodide concentration" refers to the iodide concentration that lies within 0.02 μm of the tabular grain surface.

The starting point for the preparation of an emulsion satisfying the requirements of the invention can be any conventional tabular grain emulsion in which the tabular grains (1) exhibit a face centered cubic crystal lattice of the rock salt structure and (2) have a surface iodide concentration of less than 2 mole percent.

Both silver bromide and silver chloride exhibit a face centered cubic crystal lattice of the rock salt structure (also identified by the space group designation Fm3m). Thus, the starting tabular grains can be selected from among silver bromide, silver chloride, silver chlorobromide and silver bromochloride. Although silver iodide does not form a face centered cubic crystal lattice of the rock salt structure (except under conditions not relevant to photography), minor amounts iodide can be tolerated in the face centered cubic crystal lattice rock salt structures formed by silver chloride and/or bromide. Thus, the starting tabular grains can additionally include silver iodobromide, silver iodochloride, silver iodochlorobromide, silver iodobromochloride, silver chloroiodobromide and silver bromoiodochloride compositions, provided surface iodide concentrations are limited to satisfy criterion (2) above.

In referring to silver halide grains or emulsions containing two or more halides the halides are named in the order of ascending concentrations.

Conventional tabular grain emulsions suitable for use as starting emulsions, that is, satisfying criteria (1) and (2), can be selected from among those having either {111} or {100} major faces. Suitable tabular grain emulsions containing {111} major face tabular grains are illustrated by Wey U.S. Pat. No. 4,399,215, Maskasky U.S. Pat. Nos. 4,400,463, 4,684,607, 4,713,320, 4,713,323, 5,061,617, 5,178,997, 5,178,998, 5,183,732, 5,185,239, 5,217,858 and 5,221,602, Wey et al U.S. Pat. No. 4,414,306, Daubendiek et al U.S. Pat. Nos. 4,414,310, 4,672,027, 4,693,964 and 4,914,014, Abbott et al U.S. Pat. No. 4,425,426, Wilgus et al U.S. Pat. No. 4,434,226, Kofron et al U.S. Pat. No. 4,439,520, Sugimoto et al U.S. Pat. No. 4,665,012, Yagi et al U.S. Pat. No. 4,686,176, Hayashi U.S. Pat. No. 4,748,106, Goda U.S. Pat. No. 4,775,617, Takada et al U.S. Pat. No. 4,783,398, Saitou et al U.S. Pat. Nos. 4,797,354 and 4,977,074, Tufano U.S. Pat. No. 4,801,523, Tufano et al U.S. Pat. No. 4,804,621, Ikeda et al U.S. Pat. No. 4,806,461 and EPO 0 485 946, Makino et al U.S. Pat. No. 4,853,322, Nishikawa et al U.S. Pat. No. 4,952,491, Houle et al U.S. Pat. No. 5,035,992, Takehara et al U.S. Pat. No. 5,068,173, Nakamura et al U.S. Pat. No. 5,096,806, Tsaur et al U.S. Pat. Nos. 5,147,771, '772, '773, 5,171,659, 5,210,013 and 5,252,453, Jones et al U.S. Pat. No. 5,176,991, Maskasky et al U.S. Pat. No. 5,176,992, Black et al U.S. Pat. No. 5,219,720, Maruyama et al U.S. Pat. No. 5,238,796, Antoniades et al U.S. Pat. No. 5,250,403, Zola et al EPO 0 362 699, Urabe EPO 0 460 656, Verbeek EPO 0 481 133, EPO 0 503 700 and EPO 0 532 801, Jagannathan et al EPO 0 515 894 and Sekiya et al EPO 0 547 912. Emulsions containing {100} major face tabular grains useful as starting emulsions are illustrated by Bogg U.S. Pat. No. 4,063,951, Mignot U.S. Pat. No. 4,386,156, Maskasky U.S. Pat. Nos. 5,264,337 and 5,275,930, Brust et al U.S. Pat. No. 5,314,798, House et al U.S. Pat. No. 5,320,938, Saitou et al EPO 0 569 971 and Saito et al Japanese Patent Application 92/77261.

In their simplest form the starting tabular grains contain less than 2 mole percent iodide throughout. However, the presence of higher levels of iodide within the interior of the tabular grains is compatible with the practice of the invention, provided a lower iodide shell is present that brings the starting tabular grains into conformity with criterion (2).

The surface iodide modification of the starting tabular grain emulsion to enhance sensitivity can commence under any convenient conventional emulsion precipitation condition. For example, iodide introduction can commence immediately upon completing precipitation of the starting tabular grain emulsion. When the starting tabular grain emulsion has been previously prepared and is later introduced into the reaction vessel, conditions within the reaction vessel are adjusted within conventional tabular grain emulsion preparation parameters to those present at the conclusion of starting tabular grain emulsion precipitation, taught by the starting tabular grain emulsion citations above. For starting tabular grain emulsions in which the tabular grains have {111} major faces the teachings of Kofron et al, cited above and here incorporated by reference, are generally applicable and preferred.

Iodide is introduced as a solute into the reaction vessel containing the starting tabular grain emulsion. Any water soluble iodide salt can be employed for supplying the iodide solute. For example, the iodide can be introduced in the form of an aqueous solution of an ammonium, alkali or alkaline earth iodide.

Instead of providing the iodide solute in the form of an iodide salt, it can instead be provided in the form of an organic iodide compound. Compounds of this type can be represented by the formula:

$$R—I \qquad (I)$$

wherein R represents a monovalent organic moiety that provides a carbon to iodide bond. The compounds are chosen to exhibit at least some water solubility. Hence the number of carbon atoms is preferably limited to 10 or fewer and, where 3 or more carbon atoms are present, preferably contain a polar substituent to promote water solubility. An extensive listing of such compounds are provided by Kikuchi et al EPO 0 561 415. However, whereas Kikuchi et al reacts the R—I compounds with other addenda specifically provided to achieve very rapid release of iodide, in the practice of the invention slow release of iodide is contemplated. This can be achieved by the slow reaction of the R—I compound with gelatin or a gelatin derivative contained in the emulsion. Fortuitously the organic moiety released reacts with the gelatin. Thus, iodide is released without creating a by-product that must be subsequently removed from the emulsion. The reaction of R—I compounds with gelatin and gelatin derivatives is disclosed by King et al U.S. Pat. No. 4,942,120, the disclosure of which is here incorporated by reference; however, King et al was concerned only with the modification of the gelatin and not with the release of iodide.

A common alternative method in the art for introducing iodide during silver halide precipitation is to introduce iodide ion in the form of a silver iodide Lippmann emulsion. The introduction of iodide in the form of a silver salt does not satisfy the requirements of the invention.

In the preparation of the tabular grain emulsions of the invention iodide ion is introduced without concurrently introducing silver. This creates conditions within the emulsion that drive iodide ions into the face centered cubic crystal lattice of the tabular grains. The driving force for iodide introduction into the tabular grain crystal lattice structure can be appreciated by considering the following equilibrium relationship:

$$Ag^+ + X^- \rightleftharpoons AgX \qquad (II)$$

where X represents halide. From relationship (II) it is apparent that most of the silver and halide ions at equilibrium are in an insoluble form while the concentration of soluble silver ions ($Ag^+$) and halide ions (X–) is limited. However, it is important to observe the equilibrium is a dynamic equilibrium—that is, a specific iodide is not fixed in either the right hand or left hand position in relationship (II). Rather, a constant interchange of iodide ion between the left and right hand positions is occurring.

At any given temperature the activity product of $Ag^+$ and X– is at equilibrium a constant and satisfies the relationship:

$$Ksp=[Ag^+][X^-] \quad (III)$$

where Ksp is the solubility product constant of the silver halide. To avoid working with small fractions the following relationship is also widely employed:

$$-\log Ksp=pAg+pX \quad (IV)$$

where pAg represents the negative logarithm of the equilibrium silver ion activity and pX represents the negative logarithm of the equilibrium halide ion activity. From relationship (IV) it is apparent that the larger the value of the –log Ksp for a given halide, the lower is its solubility. The relative solubilities of the photographic halides (Cl, Br and I) can be appreciated by reference to Table I:

TABLE I

| Temp. °C. | AgCl –log Ksp | AgI –log Ksp | AgBr –log Ksp |
|---|---|---|---|
| 40 | 9.2 | 15.2 | 11.6 |
| 50 | 8.9 | 14.6 | 11.2 |
| 60 | 8.6 | 14.1 | 10.8 |
| 80 | 8.1 | 13.2 | 10.1 |

From Table I it is apparent that at 40° C. the solubility of AgCl is one million times higher than that of silver iodide, while, within the temperature range reported in Table I the solubility of AgBr ranges from about one thousand to ten thousand times that of AgI. Thus, when iodide ion is introduced into the starting tabular grain emulsion without concurrent introduction of silver ion, there are strong equilibrium forces at work driving the iodide ion into the crystal lattice structure in displacement of the more soluble halide ions already present.

The benefits of the invention are not realized if all of the more soluble halide ions in the crystal lattice structure of the starting tabular grains are replaced by iodide. This would destroy the face centered cubic crystal lattice rock salt structure, since iodide can only be accommodated in a lattice structure to a limited degree, and the net effect would be to destroy the tabular configuration of the grains. Thus, it is specifically contemplated to limit the iodide ion introduced to 10 mole percent or less, preferably 5 mole percent or less, of the total silver forming the starting tabular grain emulsion. A minimum iodide introduction of at least 0.5 mole percent, preferably at least 1.0 mole percent, based on starting silver, is contemplated.

When the iodide ion is run into the starting tabular grain emulsion at rates comparable to those employed in conventional double-jet run salt additions, the iodide ion that enters the tabular grains by halide displacement is not uniformly or randomly distributed. Clearly the surface of the tabular grains are more accessible for halide displacement. Further, on the surfaces of the tabular grains, halide displacement by iodide occurs in a preferential order. Assuming a uniform surface halide composition in the starting tabular grains, the crystal lattice structure at the corners of the tabular grains is most susceptible to halide ion displacement, followed by the edges of the tabular grains. The major faces of the tabular grains are least susceptible to halide ion displacement. It is believed that, at the conclusion of the iodide ion introduction step (including any necessary introduction of iodide releasing agent), the highest iodide concentrations in the tabular grains occur in that portion of the crystal lattice structure forming the corners of the tabular grains.

The next step of the process of preparation is to remove iodide ion selectively from the corners of the tabular grains. This is accomplished by introducing silver as a solute. That is, the silver is introduced in a soluble form, analogous to that described above for iodide introduction. In a preferred form the silver solute is introduced in the form of an aqueous solution similarly as in conventional single-jet or double-jet precipitations. For example, the silver is preferably introduced as an aqueous silver nitrate solution. No additional iodide ion is introduced during silver introduction.

The amount of silver introduced is in excess of the iodide introduced into the starting tabular grain emulsion during the iodide introduction step. The amount of silver introduced is preferably on a molar basis from 2 to 20 (most preferably 2 to 10) times the iodide introduced in the iodide introduction step.

When silver ion is introduced into the high corner iodide tabular grain emulsion, halide ion is present in the dispersing medium available to react with the silver ion. One source of the halide ion comes from relationship (II). The primary source of halide ion, however, is attributable to the fact that photographic emulsions are prepared and maintained in the presence of a stoichiometric excess of halide ion to avoid the inadvertent reduction of $Ag^+$ to $Ag^o$, thereby avoiding elevating minimum optical densities observed following photographic processing.

As the introduced silver ion is precipitated, it removes iodide ion from the dispersing medium. To restore the equilibrium relationship with iodide ion in solution the silver iodide at the corners of the grains (see relationship II above) exports iodide ion from the corners of the grains into solution, where it then reacts with additionally added silver ion. Silver and iodide ion as well as chloride and/or bromide ion, which was present to provide a halide ion stoichiometric excess, are then redeposited.

To direct deposition to the edges of the tabular grains and thereby avoid thickening the tabular grains as well as to avoid silver ion reduction, the stoichiometric excess of halide ion is maintained and the concentration of the halide ion in the dispersing medium is maintained in those ranges known to be favorable for tabular grain growth. For example, for high (>50 mole percent) bromide emulsions the pBr of the dispersing medium is maintain at a level of at least 1.0. For high (>50 mole percent) chloride emulsions the molar concentration of chloride ion in the dispersing medium is maintained above 0.5M. Depending upon the amount of silver introduced and the initial halide ion excess in the dispersing medium, it may be necessary to add additional bromide and/or chloride ion while silver ion is being introduced. However, the much lower solubility of silver iodide as compared to silver bromide and/or chloride, results in the silver and iodide ion interactions described above being unaffected by any introductions of bromide and/or chloride ion.

The net result of silver ion introduction as described above is that silver ion is deposited at the edges of the tabular grains. Concurrently, iodide ion migrates from the corners of the tabular grains to their edges. As iodide ion is displaced from the tabular grain corners, irregularities are created in the corners of the tabular grains that increase their latent image forming efficiency. It is preferred that the tabular grains exhibit a corner surface iodide concentration that is at least 0.5 mole percent, preferably at least 1.0 mole percent, lower than the highest surface iodide concentration found in the grain—i.e., at the edge of the grain. As demonstrated in the Examples below, a portion of the iodide initially located adjacent the corners of the grains remains in the crystal lattice structure. Typically, the surface iodide concentrations remaining adjacent the corners of the grains approaches the final surface iodide concentrations adjacent the major surfaces of the tabular grains.

If the starting tabular grain emulsion contains no iodide, a minimum amount of iodide is introduced during the iodide introduction step, and a maximum amount of silver is introduced during the subsequent silver ion introduction step, the minimum level of iodide in the resulting emulsion can be as low as 0.4 mole percent. With higher levels of iodide introduction, lower levels of subsequent silver ion introduction, and/or iodide initially present in the starting tabular grains, much higher levels of iodide can be present in the tabular grain emulsions of the invention. Preferred emulsions according to the invention contain overall iodide levels of up to 20 mole percent, most preferably, up to 15 mole percent. A preferred minimum overall iodide concentration is 1.0 mole percent, with higher overall iodide concentrations being preferred for photographic applications depending upon iodide release for photographic advantages, such as reliance upon iodide to increase native blue sensitivity or reliance upon iodide ions released in development for interimage effects. For rapid access processing, such as is typically practiced in medical radiography, overall concentrations are preferably maintained at less than 5 mole percent, optimally at less than 3 mole percent.

In the preferred emulsions according to the invention the tabular grains account for greater than 50 percent of total grain projected area. The tabular grains most preferably account for at least 70 percent, optimally at least 90 percent, of total grain projected area. Any proportion of tabular grains satisfying the iodide profile requirements noted above can be present that is capable of observably enhancing photographic sensitivity. When all of the tabular grains are derived from the same emulsion precipitation, at least 25 percent of the tabular grains exhibit the iodide profiles described above. Preferably tabular grains accounting for at least 50 percent of total grain projected area exhibit the iodide profiles required by the invention.

Preferred emulsions according to the invention are those which are relatively monodisperse. In quantitative terms it is preferred that the coefficient of variation (COV) of the equivalent circular diameters (ECD's), based on the total grain population of the emulsion as precipitated be less than about 30 percent, preferably less than 20 percent. The COV of ECD is also referred to as $COV_{ECD}$. By employing a highly monodisperse starting tabular grain emulsion, such as an emulsion having a $COV_{ECD}$ of less than 10 percent (disclosed, for example, by Tsaur et al U.S. Pat. No. 5,210,013, the disclosure of which is here incorporated by reference), it is possible to prepare emulsions according to the invention in which $COV_{ECD}$ of the final emulsion is also less than 10. The silver bromide and iodobromide tabular grain emulsions of Tsaur et al U.S. Pat. Nos. 5,147,771, '772, '773, and 5,171,659 represent a preferred class of starting tabular grain emulsions. Sutton et al U.S. Pat. No. 5,334,469 discloses improvements on these emulsions in which the COV of tabular grain thickness, $COV_t$, is less than 15 percent.

The average tabular grain thicknesses (t), ECD's, aspect ratios (ECD/t) and tabularities ($ECD/t^2$, where ECD and t are measured in micrometers, μm) of the emulsions of the invention can be selected within any convenient conventional range. The tabular grains preferably exhibit an average thickness of less than 0.3 μm. Ultrathin (<0.07 μm mean thickness) tabular grain emulsions are specifically contemplated. Photographically useful emulsions can have average ECD's of up to 10 μm, but in practice they rarely have average ECD's of greater than 6 μm. For relatively slow speed photographic applications any minimum mean ECD of the emulsions of the invention that is compatible with average aspect ratio requirements can be employed. It is preferred to require individual grains to have parallel major faces and to exhibit an average aspect ratio of at least 2 to be considered tabular. Thus the average aspect ratio of the emulsions is always greater than 2, preferably greater than 5 and most preferably greater than 8. Extremely high average aspect ratios of 100 or more are contemplated, although typically tabular grain emulsion average aspect ratios are less than 75.

The grain structures described above result in unexpectedly high levels of photographic efficiency. That is, the speed-granularity relationships (see Kofron et al, cited above) are superior. It is a specific objective of the present invention to increase further the speed of the emulsions, without any increase in granularity (thereby improving overall efficiency) by the inclusion of, within specified concentrations and locations, a dopant capable of providing shallow electron trapping sites-hereinafter also referred to as an SET dopant.

Recently the first comprehensive explanation of the structural requirements of an SET dopant was set out in *Research Disclosure*, Item 36736, cited above. When a photon is absorbed by a silver halide grain, an electron (hereinafter referred to as a photoelectron) is promoted from the valence band of the silver halide crystal lattice to its conduction band, creating a hole (hereinafter referred to as a photohole) in the valence band. To create a latent image site within the grain, a plurality of photoelectrons produced in a single imagewise exposure must reduce several silver ions in the crystal lattice to form a small cluster of $Ag^o$ atoms. To the extent that photoelectrons are dissipated by competing mechanisms before the latent image can form, the photographic sensitivity of the silver halide grains is reduced. For example, if the photoelectron returns to the photohole, its energy is dissipated without contributing to latent image formation.

It is contemplated to dope the silver halide to create within it shallow electron traps that contribute to utilizing photoelectrons for latent image formation with greater efficiency. This is achieved by incorporating in the face centered cubic crystal lattice a dopant that exhibits a net valence more positive than the net valence of the ion or ions it displaces in the crystal lattice. For example, in the simplest possible form the dopant can be a polyvalent (+2 to +5) metal ion that displaces silver ion ($Ag^+$) in the crystal lattice structure. The substitution of a divalent cation, for example, for the monovalent $Ag^+$cation leaves the crystal lattice with a local net positive charge. This lowers the energy of the conduction band locally. The amount by which the local energy of the conduction band is lowered can be estimated by applying the effective mass approximation as described by J. F. Hamilton in the journal *Advances in Physics*, Vol. 37 (1988) p. 395 and *Excitonic Processes in Solids* by M. Ueta, H. Kanzaki, K. Kobayashi, Y. Toyozawa and E. Hanamura (1986), published by Springer-Verlag, Berlin, p. 359. If a silver chloride crystal lattice structure receives a net positive charge of +1 by doping, the energy of its conduction band is lowered in the vicinity of the dopant by about 0.048 electron volts (eV). For a net positive charge of +2 the shift is about 0.192 eV. For a silver bromide crystal lattice structure a net positive charge of +1 imparted by doping lowers the conduction band energy locally by about 0.026 eV. For a net positive charge of +2 the energy is lowered by about 0.104 eV.

When photoelectrons are generated by the absorption of light, they are attracted by the net positive charge at the dopant site and temporarily held (i.e., bound or trapped) at the dopant site with a binding energy that is equal to the local decrease in the conduction band energy. The dopant that causes the localized bending of the conduction band to a lower energy is referred to as a shallow electron trap because the binding energy holding the photoelectron at the dopant site (trap) is insufficient to hold the electron permanently at the dopant site. Nevertheless, shallow electron trapping sites are useful. For example, a large burst of photoelectrons generated by a high intensity exposure can be held briefly in shallow electron traps to protect them against immediate dissipation while still allowing their efficient migration over a period of time to latent image forming sites.

For a dopant to be useful in forming a shallow electron trap it must satisfy additional criteria beyond simply providing a net valence more positive than the net valence of the ion or ions it displaces in the crystal lattice. When a dopant is incorporated into the silver halide crystal lattice, it creates in the vicinity of the dopant new electron energy levels (orbitals) in addition to those energy levels or orbitals which comprised the silver halide valence and conduction bands. For a dopant to be useful as a shallow electron trap it must satisfy these additional criteria: (1) its highest energy electron occupied molecular orbital (HOMO, also commonly referred to as the frontier orbital) must be filled—e.g., if the orbital will hold two electrons (the maximum possible number), it must contain two electrons and not one and (2) its lowest energy unoccupied molecular orbital (LUMO) must be at a higher energy level than the lowest energy level conduction band of the silver halide crystal lattice. If conditions (1) and/or (2) are not satisfied, there will be a local, dopant-derived orbital in the crystal lattice (either an unfilled HOMO or a LUMO) at a lower energy than the local, dopant-induced conduction band minimum energy, and photoelectrons will preferentially be held at this lower energy site and thus impede the efficient migration of photoelectrons to latent image forming sites.

Metal ions satisfying criteria (1) and (2) are the following: Group 2 metal ions with a valence of +2, Group 3 metal ions with a valence of +3 but excluding the rare earth elements 58–71, which do not satisfy criterion (1), Group 12 metal ions with a valence of +2 (but excluding Hg, which is a strong desensitizer, possibly because of spontaneous reversion to $Hg^{+1}$), Group 13 metal ions with a valence of +3, Group 14 metal ions with a valence of +2 or +4 and Group 15 metal ions with a valence of +3 or +5. Of the metal ions satisfying criteria (1) and (2) those preferred on the basis of practical convenience for incorporation as dopants include the following period 4, 5 and 6 elements: lanthanum, zinc, cadmium, gallium, indium, thallium, germanium, tin, lead and bismuth. Specifically preferred metal ion dopants satisfying criteria (1) and (2) for use in forming shallow electron traps are zinc, cadmium, indium, lead and bismuth. Specific examples of shallow electron trap dopants of these types are provided by DeWitt, Gilman et al, Atwell et al, Weyde et al and Murakima et al EPO 0 590 674 and 0 563 946, each cited above.

Metal ions in Groups 8, 9 and 10 (hereinafter collectively referred to as Group VIII metal ions) that have their frontier orbitals filled, thereby satisfying criterion (1), have also been investigated. These are Group 8 metal ions with a valence of +2, Group 9 metal ions with a valence of +3 and Group 10 metal ions with a valence of +4. It has been observed that these metal ions are incapable of forming efficient shallow electron traps when incorporated as bare metal ion dopants. This is attributed to the LUMO lying at an energy level below the lowest energy level conduction band of the silver halide crystal lattice.

However, coordination complexes of these Group VIII metal ions as well as $Ga^{+3}$ and $In^{+3}$, when employed as dopants, can form efficient shallow electron traps. The requirement of the frontier orbital of the metal ion being filled satisfies criterion (1). For criterion (2) to be satisfied at least one of the ligands forming the coordination complex must be more strongly electron withdrawing than halide (i.e., more electron withdrawing than a fluoride ion, which is the most highly electron withdrawing halide ion).

One common way of assessing electron withdrawing characteristics is by reference to the spectrochemical series of ligands, derived from the absorption spectra of metal ion complexes in solution, referenced in *Inorganic Chemistry: Principles of Structure and Reactivity*, by James E. Huheey, 1972, Harper and Row, New York and in *Absorbtion Spectra and Chemical Bonding in Complexes* by C. K. Jorgensen, 1962, Pergamon Press, London. From these references the following order of ligands in the spectrochemical series is apparent:

$$I^- < Br^- < S^{-2} < \underline{S}CN^- < Cl^- < NO_3^- < F^- < \underline{O}H$$

$$< ox^{-2} < H_2\underline{O} < \underline{N}CS^- < CH_3C\underline{N}^- < \underline{N}H_3 < en < dipy$$

$$< phen < \underline{N}O_2^- < phosph << \underline{C}N^- < \underline{C}O.$$

The abbreviations used are as follows: ox=oxalate, dipy=dipyridine, phen=o-phenathroline, and phosph=4-methyl-2,6,7-trioxa-1-phosphabicyclo[2.2.2]octane. The spectrochemical series places the ligands in sequence in their electron withdrawing properties, the first ($I^-$) ligand in the series is the least electron withdrawing and the last (CO) ligand being the most electron withdrawing. The underlining indicates the site of ligand bonding to the polyvalent metal ion. The efficiency of a ligand in raising the LUMO value of the dopant complex increases as the ligand atom bound to the metal changes from C1 to S to O to N to C. Thus, the ligands $\underline{C}N^-$ and $\underline{C}O$ are especially preferred. Other preferred ligands are thiocyanate ($\underline{N}CS^-$), selenocyanate ($\underline{N}CSe^-$), cyanate ($\underline{N}CO^-$), tellurocyanate ($\underline{N}CTe^-$) and azide ($N_3^-$).

Just as the spectrochemical series can be applied to ligands of coordination complexes, it can also be applied to the metal ions. The following spectrochemical series of metal ions is reported in *Absorption Spectra and Chemical Bonding* by C. K. Jorgensen, 1962, Pergamon Press, London:

$$Mn^{+2} < Ni^{+2} < Co^{+2} < \mathbf{Fe^{+2}} < Cr^{+3}$$

$$>> V^{+3} < \mathbf{Co^{+3}} < Mn^{+4} < Mo^{+3} < \mathbf{Rh^{+3}}$$

$$>> Ru^{+3} < \mathbf{Pd^{+4}} < \mathbf{Ir^{+3}} < Pt^{+4}$$

The metal ions in boldface type satisfy frontier orbital requirement (1) above. Although this listing does not contain all the metal ions which are specifically contemplated for use in coordination complexes as dopants, the position of the remaining metals in the spectrochemical series can be identified by noting that an ion's position in the series shifts from $Mn^{+2}$, the least electronegative metal, toward $Pt^{+4}$, the most electronegative metal, as the ion's place in the Periodic Table of Elements increases from period 4 to period 5 to period 6. The series position also shifts in the same direction when the positive charge increases. Thus, $Os^{+3}$, a period 6 ion, is more electronegative than $Pd^{+4}$, the most electronegative period 5 ion, but less electronegative than $Pt^{+4}$, the most electronegative period 6 ion.

From the discussion above $Rh^{+3}$, $Ru^{+3}$, $Pd^{+4}$, $Ir^{+3}$, $Os^{+3}$ and $Pt^{+4}$ are clearly the most electro-negative metal ions satisfying frontier orbital requirement (1) above and are therefore specifically preferred.

To satisfy the LUMO requirements of criterion (2) above the filled frontier orbital polyvalent metal ions of Group VIII are incorporated in a coordination complex containing ligands, at least one, most preferably at least 3, and optimally at least 4 of which are more electronegative than halide, with any remaining ligand or ligands being a halide ligand. When the metal ion is itself highly electronegative, such $Os^{+3}$, only a single strongly electronegative ligand, such as carbonyl, for example, is required to satisfy LUMO requirements. If the metal ion is itself of relatively low electronegativity, such as $Fe^{+2}$, choosing all of the ligands to be highly electronegative may be required to satisfy LUMO requirements. For example, $Fe(II)(CN)_6$ is a specifically preferred shallow electron trapping dopant. In fact, coordination complexes containing 6 cyano ligands in general represent a convenient, preferred class of shallow electron trapping dopants.

Since $Ga^{+3}$ and $In^{+3}$ are capable of satisfying HOMO and LUMO requirements as bare metal ions, when they are incorporated in coordination complexes they can contain ligands that range in electronegativity from halide ions to any of the more electronegative ligands useful with Group VIII metal ion coordination complexes.

For Group VIII metal ions and ligands of intermediate levels of electronegativity it can be readily determined whether a particular metal coordination complex contains the proper combination of metal and ligand electronegativity to satisfy LUMO requirements and hence act as a shallow electron trap. This can be done by employing electron paramagnetic resonance (EPR) spectroscopy. This analytical technique is widely used as an analytical method and is described in *Electron Spin Resonance: A Comprehensive Treatise on Experimental Techniques*, 2nd Ed., by Charles P. Poole, Jr. (1983) published by John Wiley & Sons, Inc., New York.

Photoelectrons in shallow electron traps give rise to an EPR signal very similar to that observed for photoelectrons in the conduction band energy levels of the silver halide crystal lattice. EPR signals from either shallow trapped electrons or conduction band electrons are referred to as electron EPR signals. Electron EPR signals are commonly characterized by a parameter called the g factor. The method for calculating the g factor of an EPR signal is given by C. P. Poole, cited above. The g factor of the electron EPR signal in the silver halide crystal lattice depends on the type of halide ion(s) in the vicinity of the electron. Thus, as reported by R. S. Eachus, M. T. Olm, R. Janes and M. C. R. Simons in the journal *Physica Status Solidi(b)*, Vol. 152 (1989), pp. 583–592, in a AgCl crystal the g factor of the electron EPR signal is 1.88±0.001 and in AgBr it is 1.49±0.02.

A coordination complex dopant can be identified as useful in forming shallow electron traps in the practice of the invention if, in the test emulsion set out below, it enhances the magnitude of the electron EPR signal by at least 20 percent compared to the corresponding undoped control emulsion. The undoped control emulsion is a 0.45±0.05 μm edge length AgBr octahedral emulsion precipitated, but not subsequently sensitized, as described for Control 1A of Marchetti et al U.S. Pat. No. 4,937,180. The test emulsion is identically prepared, except that the metal coordination complex in the concentration intended to be used in the emulsion of the invention is substituted for $Os(CN6)^{4-}$ in Example 1B of Marchetti et al.

After precipitation, the test and control emulsions are each prepared for electron EPR signal measurement by first centrifuging the liquid emulsion, removing the supernatant, replacing the supernatant with an equivalent amount of warm distilled water and resuspending the emulsion. This procedure is repeated three times, and, after the final centrifuge step, the resulting powder is air dried. These procedures are performed under safe light conditions.

The EPR test is run by cooling three different samples of each emulsion to 20, 40 and 60° K, respectively, exposing each sample to the filtered output of a 200 W Hg lamp at a wavelength of 365 nm, and measuring the EPR electron signal during exposure. If, at any of the selected observation temperatures, the intensity of the electron EPR signal is significantly enhanced (i.e., measurably increased above signal noise) in the doped test emulsion sample relative to the undoped control emulsion, the dopant is a shallow electron trap.

As a specific example of a test conducted as described above, when a commonly used shallow electron trapping dopant, $Fe(CN)_6^{4-}$, was added during precipitation at a molar concentration of $50\times10^{-6}$ dopant per silver mole as described above, the electron EPR signal intensity was enhanced by a factor of 8 over undoped control emulsion when examined at 20° K.

Hexacoordination complexes are preferred coordination complexes for use in the practice of this invention. They contain a metal ion and six ligands that displace a silver ion and six adjacent halide ions in the crystal lattice. One or two of the coordination sites can be occupied by neutral ligands, such as carbonyl, aquo or ammine ligands, but the remainder of the ligands must be anionic to facilitate efficient incorporation of the coordination complex in the crystal lattice structure. Illustrations of specifically contemplated hexacoordination complexes for inclusion in the protrusions are provided by McDugle et al U.S. Pat. No. 5,037,732, Marchetti et al U.S. Pat. Nos. 4,937,180, 5,264,336 and 5,268,264, Keevert et al U.S. Pat. No. 4,945,035 and Murakami et al Japanese Patent Application Hei-2[1990]-249588. Useful neutral and anionic organic ligands for hexacoordination complexes are disclosed by Olm et al U.S. Pat. No. 5,360,712. Careful scientific investigations have revealed Group VIII hexahalo coordination complexes to create deep (desensitizing) electron traps, as illustrated R. S. Eachus, R. E. Graves and M. T. Olm *J. Chem. Phys.*, Vol. 69, pp. 4580–7 (1978) and *Phyica Status Solidi A*, Vol. 57, 429–37 (1980).

In a specific, preferred form it is contemplated to employ as a dopant a hexacoordination complex satisfying the formula:

$$[ML_6]^n \qquad (V)$$

where

M is filled frontier orbital polyvalent metal ion (preferably $Fe^{+2}$, $Ru^{+2}$ or $Os^{+2}$);

$L_6$ represents six coordination complex ligands which can be independently selected, provided that at least four of the ligands are anionic ligands and at least one (preferably at least 3 and optimally at least 4) of the ligands is more electronegative than any halide ligand (i.e., more electron withdrawing than a fluoride ion, which is the most electronegative halide ion); and n is a negative integer having an absolute value of less than 5 (preferably, −2, −3 or −4).

The following are specific illustrations of dopants capable of providing shallow electron traps:

| | |
|---|---|
| SET-1 | $[Fe(CN)_6]^{-4}$ |
| SET-2 | $[Ru(CN)_6]^{-4}$ |
| SET-3 | $[Os(CN)_6]^{-4}$ |
| SET-4 | $[Rh(CN)_6]^{-3}$ |
| SET-5 | $[Ir(CN)_6]^{-3}$ |
| SET-6 | $[Fe(pyrazine)(CN)_5]^{-4}$ |
| SET-7 | $[RuCl(CN)_5]^{-4}$ |
| SET-8 | $[OsBr(CN)_5]^{-4}$ |
| SET-9 | $[RhF(CN)_5]^{-3}$ |
| SET-10 | $[IrBr(CN)_5]^{-3}$ |
| SET-11 | $[FeCO(CN)_5]^{-3}$ |
| SET-12 | $[RuF_2(CN)_4]^{-4}$ |
| SET-13 | $[OsCl_2(CN)_4]^{-4}$ |
| SET-14 | $[RhI_2(CN)_4]^{-3}$ |
| SET-15 | $[IrBr_2(CN)_4]^{-3}$ |
| SET-16 | $[Ru(CN)_5(OCN)]^{-4}$ |
| SET-17 | $[Ru(CN)_5(N_3)]^{-4}$ |
| SET-18 | $[Os(CN)_5(SCN)]^{-4}$ |
| SET-19 | $[Rh(CN)_5(SeCN)]^{-3}$ |
| SET-20 | $[Ir(CN)_5(HOH)]^{-2}$ |
| SET-21 | $[Fe(CN)_3Cl_3]^{-3}$ |
| SET-22 | $[Ru(CO)_2(CN)_4]^{-1}$ |
| SET-23 | $[Os(CN)Cl_5]^{-4}$ |
| SET-24 | $[Co(CN)_6]^{-3}$ |
| SET-25 | $[Ir(CN)_4(oxalate)]^{-3}$ |
| SET-26 | $[In(NCS)_6]^{-3}$ |
| SET-27 | $[Ga(NCS)_6]^{-3}$ |

The SET dopants are effective in overall concentrations ranging from $1\times10^{-6}$ to $5\times10^{-4}$ mole per silver mole or, alternatively stated, from 1 to 500 molar parts per million (mppm) of silver. Preferred overall SET dopant concentrations are from 10 to 300 mppm of silver ($1\times10^{-5}$ to $3\times10^{-4}$ mole per silver mole).

As demonstrated in data below less than optimum results are obtained when the SET dopant is located too close to the surface of the grain. It is therefore contemplated to limit the surface concentration of the SET dopant to less than 100 mppm of silver forming the outer (last precipitated) 5 percent of the grain structure. Preferably the outer (last precipitated) 30 percent of the grain structure contains an SET dopant concentration of less than 100 mppm. The above teaching to limit the concentration of the SET dopant in the surface portions of the tabular grains includes, of course, entirely eliminating the SET dopant from the surface regions of the grains. That is, it is specifically contemplated and preferred to withhold the addition of SET dopant while the final, surface portion of the tabular grains are formed. The SET dopant can be confined to a narrow band or distributed in any desired manner within the interior of the grains.

Although the SET dopants can be employed effectively in emulsions according to the invention that are not spectrally sensitized, it has been observed quite unexpectedly that SET dopants provide comparatively large increases in photographic speed when employed in combination with one or more cyanine spectral sensitizing dyes exhibiting an oxidation potential (Eox) less positive than +0.87 volt and difference between dye oxidation and reduction potentials (Eox-Ered) of less than 2.10 volts. When combinations of spectral sensitizing dyes are employed, only one cyanine dye is required to satisfy Eox and Eox-Ered as noted above to realize the advantages of the invention.

The oxidation and reduction potentials of cyanine dyes have been extensively studied and hence the selection of specific cyanine dyes that satisfy these Eox and Eox-Ered preferences is well within the capability of the art. Oxidation and reduction potentials of cyanine dyes are extensively discussed in *Photographic Science and Engineering*, Vol. 18, 1974, pp. 49–53 (Sturmer et al), pp. 175–185 (Leubner) and pp. 475–485 (Gilman) and by Gilman in Vol. 19, 1975, p. 333. Oxidation and reduction potentials can be measured as described by R. J. Cox, *Photographic Sensitivity*, Academic Press, 1973, Chapter 15. The properties of spectral sensitizing dyes, together with extensive examples, are provided in *Research Disclosure*, Item 36544, cited above, Section V. Spectral sensitization and desensitization, A. Sensitizing dyes. Section V as well as Hamer *The Cyanine Dyes and Related Compounds*, John Wiley & Sons, 1964, illustrate the various forms of cyanine dyes, including simple (monomethine) cyanines, carbocyanines (trimethinecyanines), dicarbocyanines (pentamethinecyanines), tricarbocyanines (heptamethine cyanines, and complex (trinuclear) cyanines.

I. H. Leubner, *Photogr. Sci. Eng.* 22:271 (1978) has noted that as Eox-Ered decreases the wavelength of peak absorption of a cyanine dye in solution lengthens. This is illustrated by the following relationship:

$$\text{Eox-Ered}=1.145(h\nu-2.225)+1.858 \quad \text{(VI)}$$

where h is the Planck constant and v is the light frequency (which is the reciprocal of the wavelength).

Leubner further relates the peak absorption in solution (nmSol) to the J-aggregated peak absorption (nmj) by the following relationship:

$$\text{nmJ}=1.44(\text{nmSol}-500)+555 \quad \text{(VII)}$$

Thus an Eox-Ered of 1.10 volts is exhibited by cyanine dyes that exhibit a solution peak absorption (nmSol) of 793 nm or, if aggregated, a J-aggregated peak absorption (nmj) of 977 nm. For Eox-Ered of 1.20 volts the corresponding nmSol and nmj are 751 nm and 917 nm, respectively. For Eox-Ered of 1.40 volts the corresponding nmSol and nmJ are 679 nm and 813 nm, respectively. For overwhelming majority of practical applications it is contemplated that Eox-Ered of the cyanine spectral sensitizing dyes employed will be at least 1.10 volts, with most applications employing cyanine dyes with Eox-Ered values of at least 1.20 volts and, most commonly, at least 1.40 volts.

The following are specific examples of spectral sensitizing dyes exhibiting oxidation potentials less positive than +0.87 volts and for this reason preferred for use in the emulsions of the invention:

SS-1 Anhydro-5,5'-dichloro-9-ethyl-3,3'-bis(3-sulfopropyl)thiacarbocyanine hydroxide, triethylammonium salt
(Eox=+0.85 v, Ered=−1.16 v, Eox-Ered=2.01 v)

SS-2 Anhydro-9-ethyl-5,5'-dimethyl-3,3'-bis(3-sulfopropyl)thiacarbocyanine hydroxide, triethylammonium salt
(Eox=+0.76 v, Ered=−1.22 v, Eox-Ered=1.98 v)

SS-3 Anhydro-5,5'-dichloro-3,9-diethyl-3'-(3-sulfobutyl) thiacarbocyanine hydroxide
(Eox=+0.86 v, Ered=−1.15 v, Eox-Ered=2.01 v)

SS-4 Anhydro-5,5'-dimethoxy-9-methyl-3,3'-bis(3-hydroxypropyl)thiacarbocyanine hydroxide, bromide salt
(Eox=+0.75 v, Ered=−1.15 v, Eox-Ered=1.90 v)

SS-5 Anhydro-3,9-diethyl-5,5'-dimethoxy-3'-(3-sulfopropyl)thiacarbocyanine hydroxide
(Eox=+0.73 v, Ered=−1.20 v, Eox-Ered=1.93 v)

SS-6 Anhydro-5,5'-dimethoxy-9-methyl-3,3'-bis(3-sulfopropyl)thiacarbocyanine hydroxide, sodium salt
(Eox=+0.72 v, Ered=−1.22 v, Eox-Ered=1.94 v)

SS-7 Anhydro-9-ethyl-5',6'-dimethoxy-5-phenyl-3'-(3-sulfobutyl)-3-(3-sulfopropyl) oxathiacarbocyanine hydroxide
(Eox=+0.69 v, Ered=−1.34 v, Eox-Ered=2.03 v)

SS-8 Anhydro-5,6-dichoro-1-ethyl-3-(3-sulfobutyl)-3'-(3-sulfopropyl)-4',5'-benzobenzimidazolothiacarbocyanine hydroxide
(Eox=+0.68 v, Ered=−1.34 v, Eox-Ered=2.02 v)

SS-9 Anydro-9-ethyl-5,6-dimethoxy-5'-phenyl-3,3'-bis(3-sulfopropyl)thiacarbocyanine hydroxide, potassium salt
(Eox=+0.64 v, Ered=−1.24 v, Eox-Ered=1.88 v)

SS-10 Anhydro-9-ethyl-3,3'-bis(3-sulfopropyl)-4,5;4',5'-dibenzothiacarbocyanine hydroxide, sodium salt
(Eox=+0.60 v, Ered=−1.33 v, Eox-Ered=1.98 v)

In addition to the SET dopants the emulsions of the invention can optionally contain other dopants. A summary of other conventional dopants is provided by *Research Disclosure*, Item 36544, cited above, I. Emulsion grains and their preparation, D. Grain modifying conditions and adjustments, paragraph (3).

It has, for example, been observed that the selenium sensitization of emulsions is enhanced when selenium is introduced as a dopant—hereinafter also referred to as a Se dopant. Preferred selenium dopants are of the type disclosed by Wu U.S. Pat. No. 5,166,045. During precipitation of the grain portion in which the selenium dopant is to be located, a selenium donating substance is present. The selenium can be incorporated in an elemental form—i.e., $Se^{o}$—or in a divalent form in either an organic or inorganic compound. Specifically preferred inorganic compounds can take the following form:

$$M—Se—L \qquad (VIII)$$

where

M is a monovalent metal, such as an alkali metal, and

L is halogen or pseudohalogen.

The halogen can be selected from among fluoride, chloride and bromide. The term "pseudohalogen" is employed in its art recognized usage to indicate ligands that are reactively similar to halogen and are at least as electronegative as halogen. Preferably L completes with Se a selenocyanate or isoselenocyanate moiety.

In preferred organic selenium source compounds either —Se— or Se= bonding patterns can be present, with the selenium atom typically being bonded to carbon, nitrogen or phosphorus. Carbon, nitrogen or phosphorus bonds not satisfied by selenium can be satisfied by hydrogen or organic moieties, such as substituted or unsubstituted alkyl or aryl moieties containing up to about 10 carbon atoms. Lower alkyl (<6 carbon atoms and optimally <4 carbon atoms) are preferred while preferred aryl moieties are those containing from 6 to 10 carbon atoms, such as phenyl lower alkyl substituted phenyl moieties.

Specific illustrations of selenium dopant source materials for inclusion during precipitation include the following:

| | |
|---|---|
| Se-1 | Colloidal selenium |
| Se-2 | Potassium selenocyanate |
| Se-3 | Selenoacetone |
| Se-4 | Selenoacetophenone |
| Se-5 | Selenourea |
| Se-6 | Tetramethylselenourea |
| Se-7 | N-(β-carboxyethyl)-N',N'-dimethyl selenourea |
| Se-8 | N,N-dimethylselenourea |
| Se-9 | Selenoacetamide |
| Se-10 | Diethylselenide |
| Se-11 | Diphenylselenide |
| Se-12 | Bis(2,4,6-trimethylphenyl)selenide |
| Se-13 | Triphenylphosphine selenide |
| Se-14 | Tri-p-tolylselenophosphate |
| Se-15 | Tri-n-butylselenophosphate |
| Se-16 | 2-Selenopropionic acid |
| Se-17 | 3-Selenobutyric acid |
| Se-18 | Methyl-3-selenobutyrate |
| Se-19 | Allyl isoselenocyanate |
| Se-20 | N,N'-Dioctylselenourea |

Preferred concentrations of the selenium dopants are in the range of from $1\times10^{-6}$ to $7\times10^{-5}$ mole per silver mole or, alternatively stated, from 1 to 70 mppm. Selenium concentrations are based on total silver, even when the Se dopant is introduced during precipitation of only a portion of the grain. The Se dopant can be introduced during any convenient portion of or throughout grain formation, but is preferably introduced prior to halide conversion, resulting in the location of edge and corner iodide profiles, discussed above.

To maximize the performance of SET and Se dopants it is preferred to introduce these dopants into separate portions of the tabular grains. Preferably at least 10 mole percent of the total silver is precipitated between completion of introduction of one of the dopants and commencement of introduction of the remaining dopant. Although the dopants can be introduced in either order, it is preferred to complete introduction of the SET dopant before introducing the Se dopant.

An iridium dopant capable of reducing low intensity reciprocity failure is preferably incorporated in the tabular grains of the emulsions of the invention. Specific examples of iridium dopants employed to reduce low intensity reciprocity failure are contained in Kim U.S. Pat. No. 4,449,751 and Johnson U.S. Pat. No. 5,164,292, the disclosures of which are here incorporated by reference. A more general survey of iridium dopants employed to reduce reciprocity failure and for other purposes is provided by B. H. Carroll, Iridium Sensitization: A Literature Review", *Photographic Science and Engineering*, Vol. 24, No. 6, November/December 1980, pp. 265–267. A still more general survey of dopants, including iridium dopants intended to reduce reciprocity failure is provided in *Research Disclosure*, Item 36544, Section I. Emulsion grains and their preparation, D. Grain modifying conditions and adjustments, paragraphs (3) and (4). Any conventional iridium dopant known to reduce low intensity reciprocity failure can be employed in any amount known to be useful for this purpose in the practice of the invention.

In a specifically preferred form the iridium dopant is incorporated in the crystal lattice structure of the grain in the form a hexacoordination complex satisfying the formula:

$$[Ir^{+3}X_5L']^{n} \qquad (IX)$$

where

X is a halide ligand,

L' is any bridging ligand, and m is −2 or −3.

As the iridium is added during precipitation a convenient counter ion, such as ammonium or alkali metal, is associated with the hexacoordination complex, but only the anionic portion of formula IX is actually incorporated within the crystal lattice structure. Also, as introduced, the iridium can be in a +4 valence state, as illustrated, for example by Leubner et al U.S. Pat. No. 4,902,611. However, the +4 iridium reverts to the +3 valence state upon incorporation. Chloride and bromide are preferred halide ligands. The bridging ligand L' can also be a halide ligand or, alternatively, can take any convenient conventional form, including any of the various individual ligand forms disclosed in McDugle et al U.S. Pat. Nos. 4,933,272, 4,981,781 and 5,037,732, Marchetti et al U.S. Pat. No. 4,937,180, Keevert et al U.S. Pat. No. 4,945,035 and Olm et al U.S. Pat. No. 5,360,712, the disclosures of which are here incorporated by reference. Typical ligands other than chloride and bromide ligands include $H_2O$, $F^-$, $NCS^-$, $SCN^-$, $CN^-$, $NCO^-$, $I^-$, $N_3^-$, $NO_3^-$, $NO_2^-$, and organic ligands, such as substituted or unsubstituted pyrazine, pyrimidine, thiazole, oxazole, pyridine, acetonitrile and pyridazine ligands.

The iridium dopant is preferably introduced following precipitation of at least 20 (most preferably 60) percent of the silver forming the tabular grains and before 90 (most preferably 80) of the silver forming the tabular grains has been precipitated. The ideal location for the iridium dopant is in a band formed just before precipitation of the surface portion of the tabular grains, from which iridium is excluded. Preferably at least 20 (optimally at least 60) percent of total silver is precipitated before iridium is introduced.

Preferred concentrations of the iridium dopant can range up to about 800 (most preferably 140) molar parts per billion (mppb) or, alternately stated, $8\times10^{-7}$ mole per silver mole, based on total silver. Minimum effective iridium concentrations of 2.8 mppb have been reported, although concentrations of at least about 15 mppb are usually more convenient to use.

To minimize unwanted interactions between SET dopants and the iridium dopant it is preferred to precipitate an intervening band between completion of the SET dopant introduction and commencement of iridium doping. The intervening band preferably accounts for at least 10 percent of total silver and optimally at least 20 percent of total silver. Selenium and iridium dopants do not exhibit any unwanted interactions and can be introduced entirely concurrently, entirely sequentially or in any desired manner between these extremes.

Apart from the features described above the tabular grain emulsions of the invention can take any convenient conventional form. Among conventional emulsion preparation techniques specifically contemplated to be compatible with the present invention are those disclosed in *Research Disclosure*, Vol. 365, September 1994, Item 36544, I. Emulsion grains and their preparation, A. Grain halide composition, paragraph (5); C. Precipitation procedures; and D. Grain modifying conditions and adjustments, paragraphs (1) and (6).

Subsequent to their precipitation the emulsions of the invention can be prepared for photographic use as described by *Research Disclosure,* 36544, cited above, I. Emulsion grains and their preparation, E. Blends, layers and performance categories; II. Vehicles, vehicle extenders, vehicle-like addenda and vehicle related addenda; III. Emulsion washing; IV. Chemical sensitization; and V. Spectral sensitization and desensitization, A. Spectral sensitizing dyes.

The emulsions or the photographic elements in which they are incorporated can additionally include one or more of the following features illustrated by *Research Disclosure*, Item 36544, cited above: VII. Antifoggants and stabilizers; VIII. Absorbing and scattering materials; IX. Coating physical property modifying addenda; X. Dye image formers and modifiers; XI. Layers and layer arrangements; XII. Features applicable only to color negative; XIII. Features applicable only to color positive; XIV. Scan facilitating features; and XV. Supports.

The exposure and processing of photographic elements incorporating the emulsions of the invention can take any convenient conventional form, illustrated by *Research Disclosure*, Item 36544, cited above, XVI. Exposure; XVIII. Chemical development systems; XIX. Development; and XX. Desilvering, washing, rinsing and stabilizing.

EXAMPLES

The invention can be better appreciated by reference to the following specific embodiments.

EXAMPLE 1

This example has as its purpose to demonstrate the improvement in photographic speed that is realized by the iodide placement within the tabular grains, independent of dopant addition.

Emulsion A

This demonstrates an emulsion exhibiting an overall similarity to the emulsions of the invention, but lacking the specific iodide placement features of the invention.

In a 4-liter reaction vessel was placed an aqueous gelatin solution (composed of 1 liter of water, 0.56 g of alkali-processed low methionine gelatin, 3.5 ml of 4N nitric acid solution, 1.12 g of sodium bromide and having a pAg of 9.38 and 14.4 wt %, based on total silver used in nucleation, of PLURONIC-31R1™ (a surfactant satisfying the formula:

$$HO-(\overset{CH_3}{\overset{|}{C}}HCH_2O)_y-(CH_2CH_2O)_x-(\overset{CH_3}{\overset{|}{C}}HCH_2O)_{y'}-H \quad (X)$$

where x=7, y=25 and y'=25) while keeping the temperature thereof at 45° C., 11.13 mL of an aqueous solution of silver nitrate (containing 0.48 g of silver nitrate) and 11.13 mL of an aqueous solution of sodium bromide (containing 0.29 g of sodium bromide) were simultaneously added thereto over a period of 1 minute at a constant rate. The mixture was held and stirred for 1 minute during which 14 mL of an aqueous sodium bromide solution (containing 1.44 g of sodium bromide) were added at the 50 second point of the hold. Thereafter, after the 1 minute hold, the temperature of the mixture was raised to 60° C. over a period of 9 minutes. Then 16.7 mL of an aqueous solution of ammonium sulfate (containing 1.68 g of ammonium sulfate) were added and the pH of the mixture was adjusted to 9.5 with aqueous sodium hydroxide (1N). The mixture thus prepared was stirred for 9 minutes. Then 83 mL of an aqueous gelatin solution (containing 16.7 g of alkali-processed gelatin) was added, and the mixture was stirred for 1 minute, followed by a pH adjustment to 5.85 using aqueous nitric acid (1N). The mixture was stirred for 1 minute. Afterward, 30 mL of aqueous silver nitrate (containing 1.27 g of silver nitrate) and 32 mL of aqueous sodium bromide (containing 0.66 g of sodium bromide) were added simultaneously over a 15 minute period. Then 49 mL of aqueous silver nitrate (containing 13.3 g of silver nitrate) and 48.2 mL of aqueous sodium bromide (containing 8.68 g of sodium bromide) were added simultaneously at linearly accelerated rates starting from respective rates of 0.67 mL/min and 0.72 mL/min for the subsequent 24.5 minutes. Then 468 mL of aqueous silver nitrate (containing 191 g of silver nitrate) and 464 mL of aqueous sodium bromide (containing 119.4 g of sodium bromide) were added simultaneously at linear accelerated rates starting from respective rates of 1.67 mL/min and 1.70 mL/min for the subsequent 82.4 minutes. A 1 minute hold while stirring followed.

Then 80 mL of an aqueous silver nitrate solution (containing 32.6 g of silver nitrate) and 69.6 mL of an aqueous halide solution (containing 13.2 g of sodium bromide and 10.4 g of potassium iodide) were added simultaneously over a 9.6 minute period at constant rates. Then 141 mL of an aqueous silver nitrate solution (containing 57.5 g of silver nitrate) and 147.6 mL of aqueous sodium bromide (containing 38.0 g of sodium bromide) were added simultaneously over a 16.9 minute period at constant rates. The silver iodobromide emulsion thus obtained contained 3.6 mole percent iodide. The emulsion was then washed. The properties of grains of this emulsion are shown in Table II.

Emulsion B

This emulsion demonstrates the speed advantages of the iodide placement required by the invention.

The procedure used to prepare Emulsion A was employed up to the step at which iodide was introduced. From that point the precipitation proceeded as follows:

Then 16.6 mL of an aqueous potassium iodide solution (containing 10.45 g of potassium iodide) were added over a three minute period at constant flow rate. The solution was delivered to a position in the kettle such that mixing was maximized. After a 10 minute hold, 220.8 mL of an aqueous silver nitrate solution (containing 90.1 g of silver nitrate) were added over a 26.5 minute period at constant flow rate. Then 6.5 minutes after the start of the silver nitrate addition 164.2 mL of aqueous sodium bromide (containing 42.2 g of sodium bromide) were added over a 20.0 minute period at a constant rate. The silver halide emulsion thus obtained contained 3.6 mole percent iodide. The emulsion was then washed. The properties of grains of this emulsion are shown in Table II.

TABLE II

Comparison of the Grain Properties

| | Average Grain Size (μm) | Thickness (μm) | Aspect Ratio | Average Tabularity | $COV_{BCD}$ (%) |
|---|---|---|---|---|---|
| Emulsion A | 2.37 | 0.11 | 22 | 196 | 9.8 |
| Emulsion B | 2.31 | 0.12 | 19 | 160 | 9.3 |

Photographic Comparison

The emulsions listed in Table II were optimally sulfur and gold sensitized and minus blue sensitized with a combination of anhydro-5-chloro-9-ethyl-5'-phenyl-3'-(3-sulfobutyl)-3-(3-sulfopropyl)-oxacarbocyanine hydroxide, sodium salt (Eox=1.05 volts, Ered=−1.31 volts, Eox-Ered=2.36 volts) (SS-11) and anhydro-3,9-diethyl-3'-[N-(methylsulfonyl) carbamoylmethyl]-5-phenylbenzothiazolooxacarbocyanine hydroxide, inner salt (Eox=0.80 volts, Ered=−1.30 volts, Eox-Ered=2.10 volts)(SS-12) in an 8.2:1 ratio by weight, as the sensitizing dyes present in the finish. Single layer coatings on a transparent film support employed cyan dye-forming coupler (CC-1) at a coating coverage of 1.6 mg/dm$^2$ and a silver coating coverage of 8.1 mg/dm$^2$.

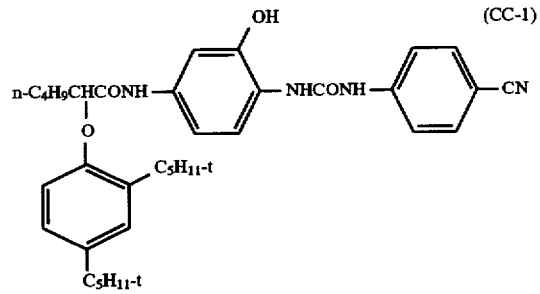

A sample of each coating was exposed by a tungsten light source through a graduated density test object and a Wratten 9™ filter, which permits significant transmission at wavelengths longer than 480 nm. Processing was conducted using the Eastman Flexicolor™ color negative processing chemicals and procedures.

Sensitometric speed comparisons are provided in Table III. Speed was measured at an optical density of 0.15 above minimum density. Emulsion A was assigned a relative speed of 100, and each unit of difference in reported relative speeds is equal to 0.01 log E, where represents exposure in lux-seconds.

TABLE III

Speed Comparisons

| Emulsion | Relative Speed |
|---|---|
| A | 100 |
| B | 111 |

To provide a frame of reference, in photography a relative speed increase of 30 (0.30 log E) allows one full stop reduction in exposure. Thus, it is apparent that the emulsion of the invention would allow a photographer a one half stop reduction in exposure.

Morphology Comparison

Grains from both Emulsions A and B were examined microscopically and observed to contain different tabular grain structures.

The iodide concentrations of a representative sample of the tabular grains were examined at different points across their major faces, either from edge-to-edge or corner-to-corner (see lines E—E and C—C, respectively, in the Brief Description of the Drawings above). Analytical electron microscopy (AEM) was employed. A major face of each tabular grain examined was addressed at a succession of points, and the average iodide concentration through the entire thickness of the tabular grain at each point addressed was read and plotted.

In FIG. 2 an edge-to-edge plot E2 and a corner-to-corner plot C2 are shown for a representative tabular grain taken from Emulsion A. Notice that in both plots the highest iodide concentration is found at the periphery of the tabular grain. There is no significant difference between the iodide concentration at a corner of the grain and at a peripheral location between the corners. All of the tabular grains examined from Emulsion A exhibited these edge and corner iodide profile characteristics.

A total of 60 tabular grains were examined from Emulsion B were examined. Of these 17 exhibited edge-to-edge and corner-to-corner iodide profiles similar to the tabular grains of Emulsion A. However, 43 of the tabular grains exhibited unique and surprising iodide profiles. An edge-to-edge iodide profile E1 and a corner-to-corner iodide profile C1 is shown in FIG. 1 for a tabular grain representative of the 43 tabular grains having unique structures. Notice that the highest iodide concentration is observed at the tabular grain peripheral edges of the edge-to-edge plot E1. On the other hand, the corner-to-corner plot C1 shows no significant variation in iodide content at the tabular grain periphery. Clearly the highest iodide concentrations in these unique tabular grains are located at the edges of the tabular grains, but the iodide content within the corners of the tabular grains are clearly significantly lower than that observed elsewhere along the tabular grain peripheral edges.

EXAMPLE 2

This example demonstrates the further increase in speed that is attainable by adding to the iodide placement required by the invention, demonstrated in Example 1, an SET dopant and the selection of a spectral sensitizing dye that exhibits an oxidation potential less positive than +0.87 volt.

Emulsion C

This emulsion satisfied the iodide placement required by the invention, but did not contain an SET dopant.

A vessel equipped with a stirrer was charged with 6 L of water containing 3.4 g of oxidized bone gelatin, 6.7 g of sodium bromide, 0.5 g of surfactant Pluronic 31R1™ (see formula X above) and sufficient nitric acid to achieve a pH of 1.85 at 45° C. While keeping the temperature at 45° C., 68 mL of an aqueous solution of silver nitrate (containing 2.88 g of silver nitrate) and 68 mL of an aqueous solution of sodium bromide (containing 1.75 g of sodium bromide) were simultaneously added over a period of 1 minute at a constant rate. The mixture was held and stirred for 1 minute during which 84 mL of an aqueous sodium bromide solution (containing 8.64 g of sodium bromide) were added. Thereafter, the temperature of the mixture was raised to 60° C. over a period of 9 minutes. Then 100 mL of an aqueous solution of ammonium sulfate (containing 10 g of ammonium sulfate) were added, and the pH of the mixture wad adjusted to 9.5 with aqueous sodium hydroxide. The mixture thus prepared was stirred for 9 minutes. Then 500 mL of an aqueous gelatin solution (containing 100 g of oxidized bone gelatin) were added, and the mixture was stirred for 1 minute, followed by a pH adjustment of 5.85 using nitric acid. The mixture was stirred for 1 minute. Afterwards, 180 mL of aqueous silver nitrate (containing 7.65 g of silver nitrate) and 192 mL of aqueous sodium bromide (containing 3.96 g of sodium bromide) were added simultaneously over a 15 minute period. Then 294 mL of aqueous silver nitrate (containing 79.8 g of silver nitrate) and 288 mL of aqueous sodium bromide (containing 52 g of sodium bromide) were added simultaneously at linearly accelerated rates starting from respective rates of 4 mL/min and 4.3 mL/min for the subsequent 24.5 minutes. Then 2802 mL of aqueous silver nitrate (containing 1146 of silver nitrate) and 2784 mL of aqueous sodium bromide (containing 716.9 g of sodium bromide) were added simultaneously at linearly accelerated rates starting from respective rates of 10 mL/min and 10.2 mL/min for the subsequent 82.4 minutes. A 1 minute hold while stirring followed.

Then 200 mL of an aqueous potassium iodide solution (containing 62.4 g of potassium iodide) were added over a two minute period at a constant flow rate. The solution was delivered to a position in the kettle such that mixing was maximized. After a 10 minute hold, 1325 mL of an aqueous silver nitrate solution (containing 540.6 g of silver nitrate) were added over a 26.5 minute period at a constant flow rate. Then, 6.5 minutes after the start of the silver nitrate addition, 985 mL of an aqueous silver bromide solution (containing 253.6 g of sodium bromide) were added over a 20 minute period at a constant rate.

The silver halide emulsion thus obtained contained 3.6 mole percent iodide. The properties of the grains of this emulsion are shown in Table IV below.

Emulsion D

This emulsion was prepared similarly as Emulsion C, except that an SET dopant was additionally added.

Before the addition of the potassium iodide solution an aqueous solution containing 0.22 g of potassium hexacyanoruthenate ($5.1\times10^{-5}$ mole per silver mole, based on total silver) was added to the mixture.

The properties of the grains of this emulsion are shown in Table IV below.

TABLE IV

Comparison of the Grain Properties

| | Average Grain Size (μm) | Average Thickness (μm) | Aspect Ratio |
|---|---|---|---|
| Emulsion C | 2.42 | 0.11 | 22 |
| Emulsion D | 2.35 | 0.11 | 21 |

Photographic Comparison

The emulsions listed in Table IV were optimally sulfur and gold sensitized and red sensitized with a combination of SS-1 and SS-2 in a 9:1 molar ratio, as the sensitizing dyes present in the finish. Single layer coatings on a transparent film support employed cyan dye-forming coupler (CC-1) at a coating coverage of 9.69 mg/dm$^2$ and a silver coating coverage of 10.76 mg/dm$^2$.

A sample of each coating was exposed by a tungsten light source through a graduated density test object and a Wratten 23A™ filter, which permits significant transmission at wavelengths longer than 560 nm. Processing was conducted using the Eastman Flexicolor™ color negative processing chemicals and procedures.

Sensitometric speed comparisons are provided in Table V. Speed was measured as described in Example 1.

TABLE V

Speed Comparisons

| Emulsion | Relative Speed |
|---|---|
| C | 100 |
| D | 122 |

EXAMPLE 3

This example demonstrates the effect of varied levels and placements of the SET dopant.

All of the emulsions were prepared and evaluated as described in Example 2, except for the variation of the level and placement of the potassium hexacyanoruthenate dopant.

The significant varied parameters and resulting photographic speeds are summarized in Table VI.

TABLE VI

Varied Dopant Concentrations and Placements

| Emulsion | Dopant Level mppm (mg/Ag mole) | Dopant Profile % | Relative Speed |
|---|---|---|---|
| E | 0 (0) | 0 | 100 |
| F | 25 (11) | 66–68 | 124 |
| G | 50 (21) | 6–8 | 123 |
| H | 50 (21) | 66–68 | 127 |
| I | 50 (21) | 93–95 | 122 |
| J | 50 (21) | 2–68 | 127 |
| K | 200 (84) | 6–8 | 124 |
| L | 200 (84) | 93–95 | 104 |

Dopant Profile % refers to the interval of dopant introduction, referenced to the percent of total silver present in the reaction vessel at the start and finish of dopant introduction.

From Table VI it is apparent that the SET dopant increased speed at all concentrations and with all dopant profiles. However, Emulsion L, which employed a higher concentration of SET dopant nearer the grain surface demonstrated a lower increase in speed than the remaining doped emulsions. This indicates that SET dopant concentrations should be limited adjacent the surface of the grains. The highest speeds were observed when at least 30 percent of total silver was introduced following dopant introduction.

EXAMPLE 4

This example has as its purpose to demonstrate the enhanced sensitivity of an emulsion according to the invention when spectrally sensitized to the blue and green regions of the spectrum.

Emulsion M

This emulsion is provided for purposes of comparison. Unlike the emulsion of the invention, described below, it does not contain an SET dopant.

A vessel equipped with a stirrer was charged with 6 liters of water containing 6.8 g of oxidized bone gelatin, 6.7 g of sodium bromide, 2 g of surfactant PLURONIC 31R1™ (see formula VIII above for formula), and sufficient nitric acid to achieve a pH of 1.85 at 45° C. While keeping the temperature at 45° C., 42.4 mL of an aqueous solution of silver nitrate (containing 3.60 g of silver nitrate) and 42.7 mL of an aqueous solution of sodium bromide (containing 2.29 g of sodium bromide) were simultaneously added over a period of 1 minute at a constant rate. The mixture was held and stirred for 1 minute during which 86 mL of an aqueous sodium bromide solution (containing 8.82 g of sodium bromide) was added. Thereafter, the temperature of the mixture was raised to 60° C. over a period of 9 minutes. Then, 101 mL of an aqueous solution of ammonium sulfate (containing 10.2 g of ammonium sulfate) were added, and the pH of the mixture was adjusted to 9.5 with aqueous sodium hydroxide. The mixture thus prepared was stirred for 9 minutes. Then 1594 mL of an aqueous gelatin solution (containing 100 g of oxidized bone gelatin) were added, and the mixture was stirred for 1 minute, followed by a pH adjustment to 5.85 using nitric acid. The mixture was stirred for 1 minute. Afterwards, 151.4 mL of aqueous silver nitrate (containing 12.86 g of silver nitrate) and 256 mL of aqueous sodium bromide (containing 13.7 g of sodium bromide) were added simultaneously over a 15 minute period. Then 936.2 mL of aqueous silver nitrate (containing 79.54 g of silver nitrate) and 1058 mL of aqueous sodium bromide (containing 56.6 g of sodium bromide) were added at linearly accelerated rates starting from respective rates of 11.51 mL/minute and 12.84 mL/minute for the subsequent 32 minutes. Then 2834 mL of aqueous silver nitrate (containing 1156 g of silver nitrate) and 2864 mL of aqueous sodium bromide (containing 736.8 g of sodium bromide) were added simultaneously at linear accelerated rates starting from respective rates of 10.1 mL/minute and 9.66 mL/minute for the subsequent 82.4 minutes.

Then 265 mL of aqueous potassium selenocyanate (containing 0.305 g of potassium selenocyanate) were added over a 2 minute period.

Then 143.5 mL of an aqueous potassium iodide solution (containing 65.5 g of potassium iodide) were added over a two minute period at constant flow rate. The solution was delivered to a position in the kettle such that mixing was maximized. After a 10 minute hold 1337 mL of an aqueous silver nitrate solution (containing 545.0 g of silver nitrate) were added over a 26.5 minute period at constant flow rate. Then, 9.0 minutes after the start of the silver nitrate addition, 850 mL of an aqueous sodium bromide solution (containing 218.7 g of sodium bromide) were added at constant rate for a 17.5 minute period. The silver halide emulsion obtained contained 3.7 mole percent iodide. The emulsion was then washed.

The properties of the grains of this emulsion are shown in Table VII.

Emulsion N

This emulsion demonstrates an emulsion according to the invention containing an SET dopant.

An emulsion was prepared following the same procedure as for Emulsion M, except as follows: The potassium selenocyanate solution was omitted and 61 mL of an aqueous solution containing 0.22 gram (corresponding to 50 mppm, based on total silver) of potassium hexacyanoruthenate was added to the mixture during the time corresponding to the addition of 66 to 68 percent of the total silver.

The properties of the grains of this emulsion are shown in Table VII.

TABLE VII

Comparison of Grain Properties

| | Average Grain Size (μm) | Average Thickness (μm) | Aspect Ratio |
|---|---|---|---|
| Emulsion M | 2.31 | 0.10 | 23 |
| Emulsion N | 2.31 | 0.10 | 23 |

Photographic Comparison

The emulsions listed in Table VII were optimally spectrally and chemically sensitized. Chemical sensitizers were conventional sulfur and gold sensitizers. Spectrally sensitizers included either green or blue dyes.

The green sensitizing dyes were used in a molar ratio of 4.5 to 1. The green sensitizing dye present in the larger amount was SS-11, and the green sensitizing dye present in the smaller amount was SS-12.

The blue sensitizing dye was anhydro-5,5'-dichloro-3,3'-bis(3-sulfopropyl)thiacyanine hydroxide, triethyl ammonium salt (Eox=1.39 volts, Ered=−1.38, Eox-Ered=2.77 volts)(SS-13).

The sensitized emulsions were combined with a cyan-dye forming coupler (CC-1) and coated on a photographic film support with a silver coverage of 807 mg/m$^2$ (75 mg/ft$^2$). A sample of each coating was exposed with a tungsten light source for 1/50th second. Blue-sensitized film samples were exposed through a Wratten 2B™ filter, which transmits at wavelengths longer than 390 nm. Green-sensitized film samples were exposed through a Wratten 9™ filter. Exposed film samples were developed for 3 minutes and 15 seconds using Kodak Flexicolor™ C-41 color negative processing.

Speed was measured as described previously.

TABLE VIII

Photographic Comparison, Relative Speed

| Emulsion | Green-sensitized Wratten 9 exposure | Blue-sensitized Wratten 2B exposure |
|---|---|---|
| M | 100 | 100 |
| N | 106 | 111 |

An increase in speed attributable to the presence of an SET dopant in the blue or green spectrally sensitized emulsions is clearly noted.

EXAMPLE 5

This example as its purpose to demonstrate that cyanine dyes Eox-Ered of <2.10 volts produce in the SET doped emulsions of the invention an unexpected larger increase in speed than cyan dyes that fail to satisfy this relationship. Except as otherwise stated the details of emulsion features, film construction, exposure and processing are found in the preceding examples.

Two pairs of emulsions were selected for comparison:

TABLE IX

Comparison of the Grain Properties

| Emulsion | Average Grain Size (μm) | Average Thickness (μm) | Aspect Ratio |
|---|---|---|---|
| E (−SET) | 2.65 | 0.12 | 22 |
| G (+SET) | 2.70 | 0.11 | 25 |
| M (−SET) | 2.31 | 0.10 | 23 |
| N (+SET) | 2.31 | 0.10 | 23 |

The properties of the cyanine dyes employed in spectral sensitization are summarized below:

TABLE X

Comparison of Dye Properties

| Dye | Eox (volts) | Ered (volts) | Eox-Ered (volts) | Peak Absorption |
|---|---|---|---|---|
| SS-1 | +0.85 | −1.16 | 2.01 | Red |
| SS-2 | +0.76 | −1.22 | 1.98 | Red |
| SS-11 | +1.05 | −1.31 | 2.36 | Green |
| SS-13 | +1.39 | −1.38 | 2.77 | Blue |
| SS-14 | +0.78 | −1.45 | 2.23 | Green |

SS-14 Anhydro-6,6'-dichloro-3,3'-bis(3-sulfo-propyl)-5,5'-ditrifluoromethylbenzimidazolocarbocyanine hydroxide, sodium salt Photographic Comparison

TABLE XI

Correlation of SET, Dye and Performance Properties

| Emulsion | Dye | Eox (volts) | Eox-Ered (volts) | Relative Speed |
|---|---|---|---|---|
| M(−SET) | SS-13 | +1.39 | 2.77 | 100 |
| N(+SET) | SS-13 | | | 111 |
| E(−SET) | SS-11 | +1.05 | 2.36 | 100 |
| | SS-14 | +0.78 | 2.23 | |
| G(+SET) | SS-11 | | | 111 |
| | SS-14 | | | |
| E(−SET) | SS-1 | +0.85 | 2.01 | 100 |
| | SS-2 | +0.76 | 1.98 | |
| G(+SET) | SS-1 | | | 123 |
| | SS-2 | | | |

SS-11:SS-14 = 3:1 (molar ratio)

From Table XI it is apparent that the SET dopant in the emulsions of the invention produced an unexpectedly large speed enhancement in combination with one or more spectral sensitizing dyes exhibiting an oxidation potential (Eox) less positive than +0.87 volt and a difference between oxidiation and reduction potentials (Eox-Ered) of less than 2.10 volts.

The invention has been described in detail with particular reference to preferred embodiments thereof, but it will be understood that variations and modifications can be effected within the spirit and scope of the invention.

What is claimed is:

1. An emulsion of enhanced photographic sensitivity comprised of a dispersing medium and silver halide tabular grains having a face centered cubic crystal lattice of the rock salt structure and containing iodide, adjacent surfaces forming edges and corners of said tabular grains WHEREIN the tabular grains contain a maximum surface iodide concentration along their edges, a lower surface iodide concentration within their corners than elsewhere along their edges, and a dopant capable of providing shallow electron trapping sites present in an overall concentration of up to 500 molar parts per million, based on silver, and limited to a surface concentration of less than 100 molar parts per million, based on the last precipitated 5 percent of silver.

2. An emulsion according to claim 1 wherein the tabular grains contain an overall iodide concentration of up to 20 mole percent, based on total silver.

3. An emulsion according to claim 1 wherein the tabular grains contain at least 50 mole percent bromide, based on total silver.

4. An emulsion according to claim 1 wherein the surface iodide concentration of the tabular grains at a corner is at least 0.5 mole percent less than the maximum edge surface iodide concentration.

5. An emulsion according to claim 4 wherein the surface iodide concentration of the tabular grains at a corner is at least 1.0 mole percent less than the maximum edge surface iodide concentration.

6. An emulsion according to claim 1 wherein the dopant capable of providing shallow electron trapping sites is present in an overall concentration of from 10 to 300 molar parts per million, based on silver.

7. An emulsion according to claim 1 wherein the dopant capable of providing shallow electron trapping sites is limited to a surface concentration of less than 100 molar parts per million, based on the last precipitated 30 percent of silver.

8. An emulsion according to claim 1 wherein the emulsion additionally contains a spectral sensitizing dye.

9. An emulsion according to claim 8 wherein the spectral sensitizing dye is a cyanine dye that exhibits an oxidation potential that is less positive than +0.87 volt and potential difference between its oxidation and reduction potentials of less than 2.10 volts.

10. An emulsion according to claim 9 wherein the cyanine dye exhibits a potential difference between its oxidation and reduction potentials of at least 1.10 volts.

* * * * *